US006338261B1

(12) United States Patent
Liu

(10) Patent No.: US 6,338,261 B1
(45) Date of Patent: Jan. 15, 2002

(54) LOCK WITH A REPLACEABLE CYLINDER

(76) Inventor: Ten-Kao Liu, No. 22, Lane 5, Da-Lien Road, Pin Tong City (TW)

( * ) Notice: Subject to any disclaimer, the term of this patent is extended or adjusted under 35 U.S.C. 154(b) by 0 days.

(21) Appl. No.: 09/392,532

(22) Filed: Sep. 9, 1999

(51) Int. Cl.[7] ..... E05B 67/36
(52) U.S. Cl. ..... 70/34; 70/2; 70/14; 70/371
(58) Field of Search ..... 70/14.2, 32–34, 70/369–371, 416, 417, 51, 52

(56) References Cited

U.S. PATENT DOCUMENTS 3,769,821 A * 11/1973 Randel ..... 70/33
5,127,244 A * 7/1992 Myers ..... 70/2
5,345,794 A * 9/1994 Jenks ..... 70/14
6,185,966 B1 * 2/2001 Chen ..... 70/417 X

* cited by examiner

*Primary Examiner*—Suzanne Dino Barrett
(74) *Attorney, Agent, or Firm*—Rosenberg, Klein & Lee

(57) ABSTRACT

A lock includes a case with a sleeve received therein. The sleeve is connected to the case by a bolt. A cylinder is rotatably received in the sleeve and a locking bar is connected to the cylinder by a pin, the locking bar having an elongated head engaged with a recess in the case. A plurality of locking pins biased by springs radially extend in to the sleeve. The sleeve can be replaced by removing the bolt from the case, and the cylinder can be disengaged from the locking bar by removing the pin connecting the two members.

3 Claims, 9 Drawing Sheets

LOCK WITH A REPLACEABLE CYLINDER

FIELD OF THE INVENTION

The present invention relates to a lock which has a cylinder connected with a locking bar by a pin, the cylinder and/or the locking pins in the cylinder can be easily replaced.

BACKGROUND OF THE INVENTION

A conventional lock includes a case having a cylinder rotatably received in the case, a plurality of locking pins movably received in the casing and biased by springs. The locking pins radially extend into the cylinder so as to be located between the boundary surface between the case and the cylinder when the lock is in locked position. The cylinder has a key hole for receiving a key therein, the key has serrations on a side thereof so that when the key is inserted into the key hole, the locking pins are pushed into the case by the insertion of the serrations, and when the key is completely engaged with the key hole in the cylinder, the locking pins are pushed by the springs and engaged with the serrations so that the boundary surface will not be stopped by the locking pins. Therefore, when rotating the key, the cylinder is rotated to disengage the shackle or the like to unlock the lock. The case generally is made of steel and the cylinder is generally made of copper which is softer than the steel, so that the cylinder and/or the locking pins will be worn out and this could affect the precision of the locking pins in the unlock positions. That is the reason why the cylinder of a used lock is difficult to be rotated.

The present invention intends to provide a lock whose cylinder and/or locking pins can be easily replaced while the case is remained the same. The present invention provides a way to resolve the inherent disadvantage of the conventional lock.

SUMMARY OF THE INVENTION

In accordance with one aspect of the present invention, there is provided a lock comprising a case which has slot and a recess and a passage are respectively defined in the case and communicate with the slot. A locking bar extends through an engaging hole in the case and which communicates with the passage. A sleeve is connected to a base member, and both the sleeve and the base member are received in the engaging hole by a bolt. The locking bar extends through the sleeve and has an elongated head which is engaged with the recess in the case. A plurality of chambers are defined radially through the sleeve and the base member, each chamber having a tube and a locking pin, both of the tube and the locking pin are biased by a spring received in the chamber in the base member. A cylinder has a key hole and is rotatably received in the sleeve. The cylinder is connected to the locking bar by a pin.

The object of the present invention is to provide a lock whose cylinder can be independently replaced regardless of the case.

Another object of the present invention is to provide a lock whose locking pins in the cylinder can be replaced regardless of the cylinder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
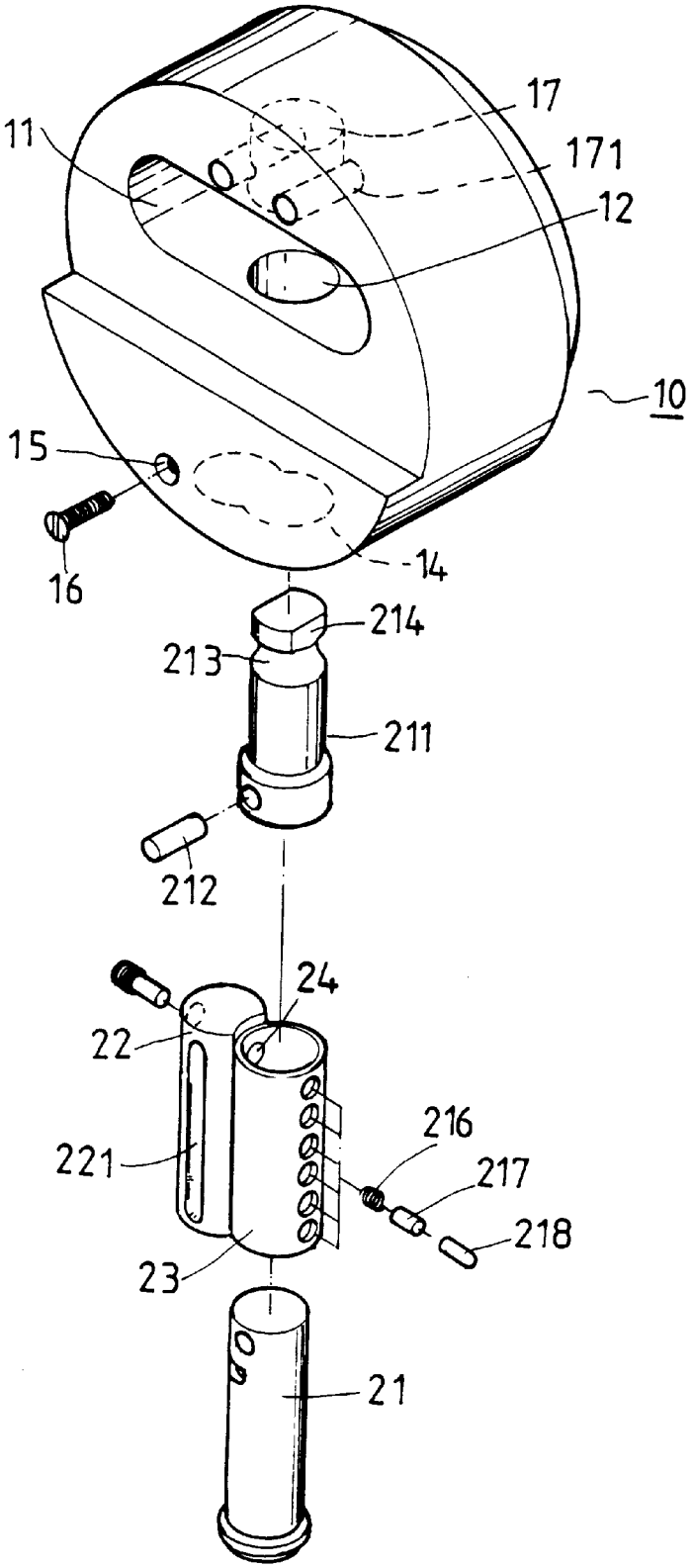
FIG. 1 is an exploded view of the lock in accordance with the present invention.
Figure 2:
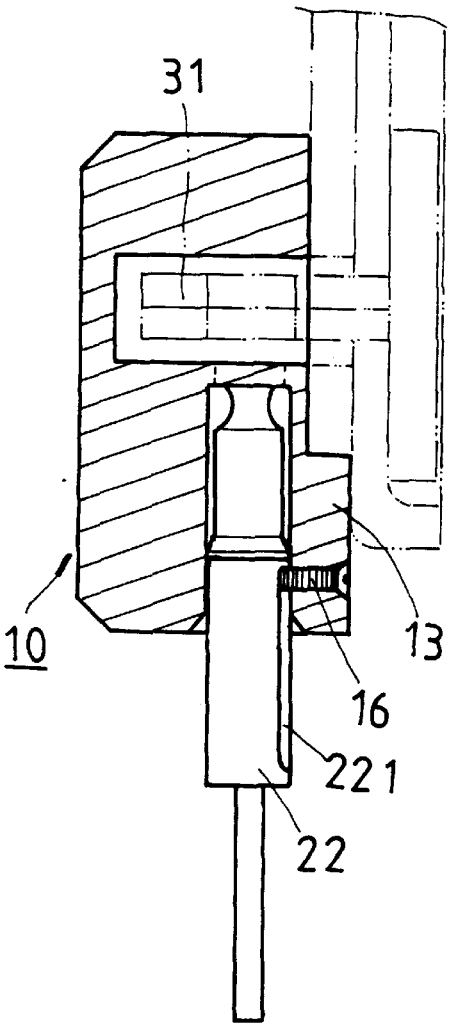
FIG. 2 is a side elevational view, partly in section, of the lock in accordance with the present invention, wherein the lock is in an unlock status.
Figure 3:
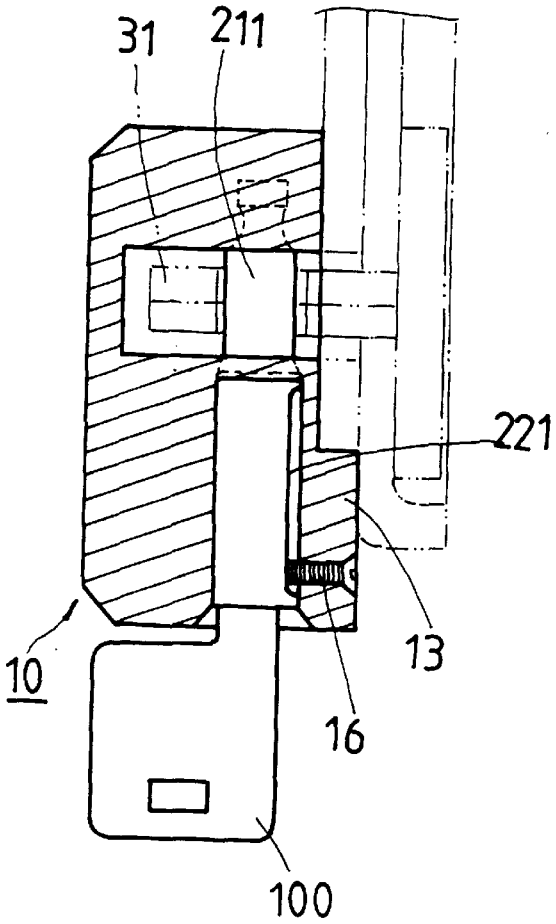
FIG. 3 is a side elevational view, partly in section, of the lock in accordance with the present invention, wherein the lock is in a locked status.
Figure 12:
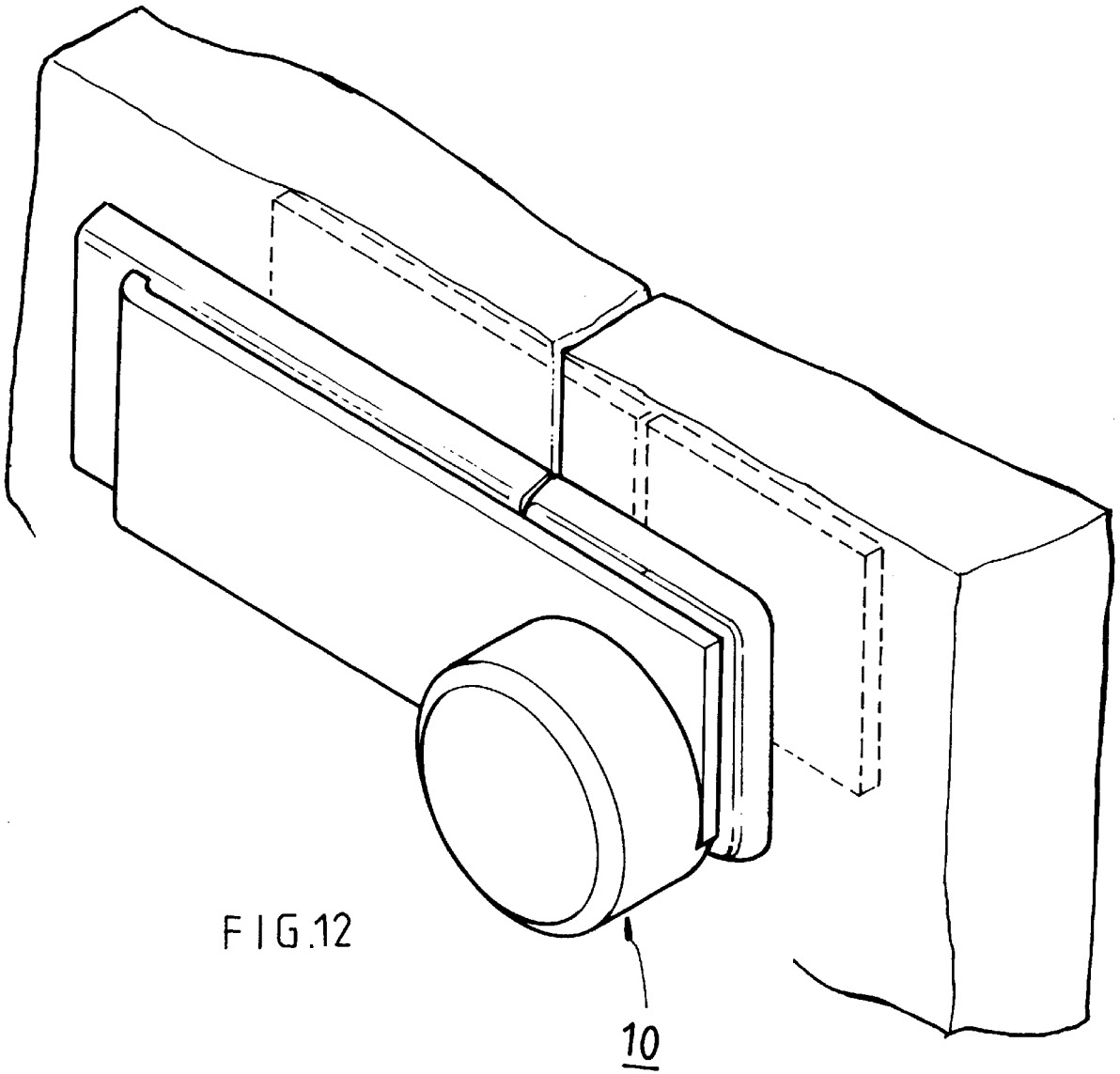
FIG. 12 is an illustrative view to show the lock of the present invention is used to lock two members.

Referring to FIGS. 1 to 3, the lock in accordance with the present invention comprises a case 10 having a slot 11 defined in a side thereof so that when locking two members as shown in FIG. 12, a tongue 31 as shown in FIGS. 2 and 3 of the two members can be inserted from the slot 11. The slot 11 is defined by a first inside and a second inside, a recess 17 defined in the first inside and having a narrow neck portion, and a passage 12 defined through the second inside. An engaging hole 14 is defined in the case 10 and communicates with the passage 12. The narrow neck portion in the recess 17 is defined by two positioning bars 171 respectively located in the recess 17.

A sleeve 23 is connected to a base member 22 so as to form an "8" shaped member which is removably received in the engaging hole 14. A notch 221 is defined in the base member 22 and a threaded hole 15 is defined through the case 10 and communicates with the engaging hole 14 in the case 10. A bolt 16 threadedly extends through the threaded hole 15 and is engaged with the notch 221 so that the sleeve 23 and the base member 22 are retained in the case 10. A cylinder 21 has a key hole 210 and is rotatably received in the sleeve 23. The cylinder 21 is connected to a second end of the locking bar 211 by a pin 212. The notch 221 is a long notch so that when the key 100 is not yet inserted into the cylinder 21, the base member 22 is stopped by the bolt 16 at one of two ends of the notch 221 as shown in FIG. 2.

Figure 4:
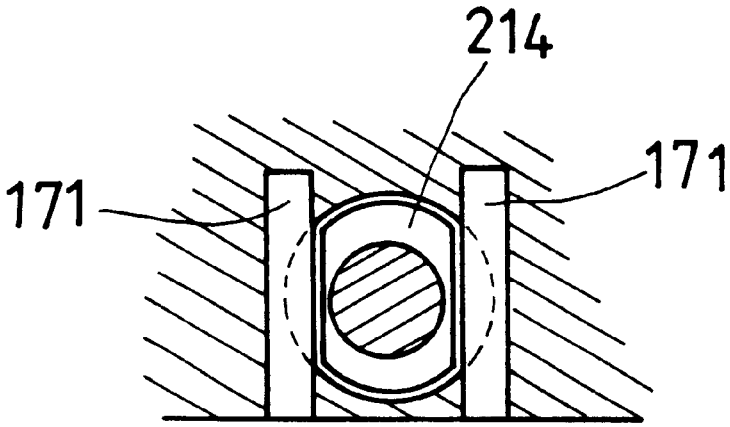
FIG. 4 is a cross-sectional view to show the elongated head of the locking bar and the narrow neck portion in the recess of the case when in an unlock status.
Figure 5:
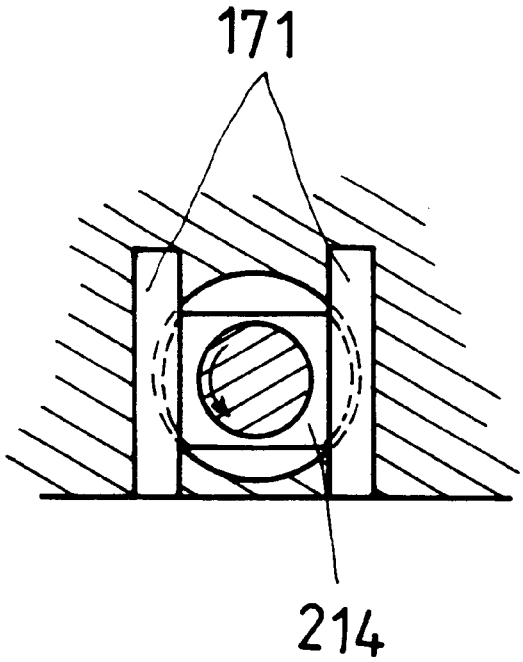
FIG. 5 is a cross-sectional view to show the elongated head of the locking bar and the narrow neck portion in the recess of the case when in a locked status.
Figure 6:
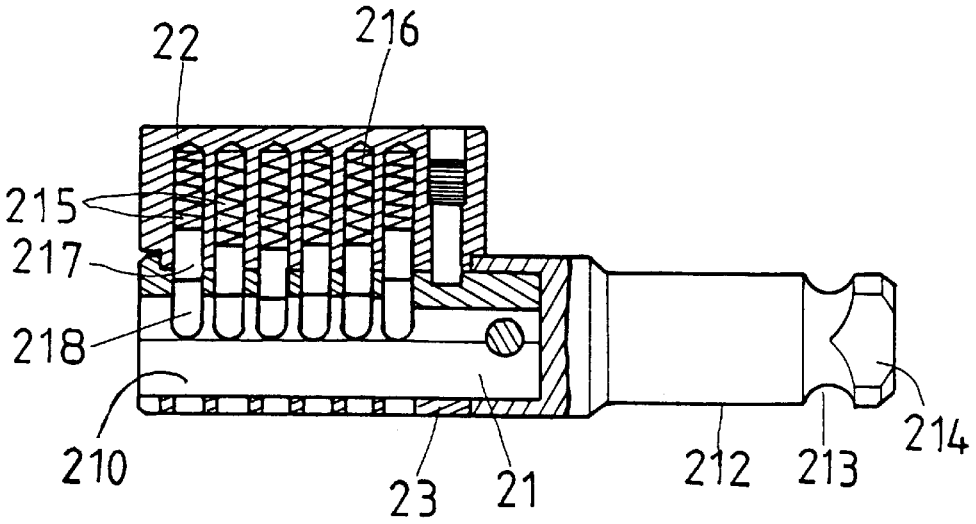
FIG. 6 is a cross-sectional view to show the locking pins located between the cylinder and the sleeve when in a locked status.

When inserting the key 100, the base member 22 is inserted into the case 10 and the bolt 16 contacts the other end of then notch 221, and the locking bar 211 is inserted into the recess 17 as shown in FIG. 3. A locking bar 211 has a first end with a groove 213 and an elongated head 214, and the locking bar 211 is received in the sleeve 23 so that the elongated head 214 is received in the recess 17 in the case 10 and an inner periphery defining the narrow neck portion is engaged with the groove 213 in the locking bar 211 as shown in FIGS. 4 and 5. The elongated head 214 has two sides which are located between the two positioning bars 171 when the lock is in unlock status. On the contrary, when the locking bar 211 is rotated to let the two ends of the elongated head 214 be engaged with the two positioning bars 171, the lock is locked. Further referring to FIG. 6, a plurality of chambers 24 are defined radially through the sleeve 23 and the base member 22, each chamber 24 having a tube 217 and a locking pin 218, and both of the tube 217 and the locking pin 218 being biased by a spring 216 received in the chamber 24 in the base member 22.

Figure 7:
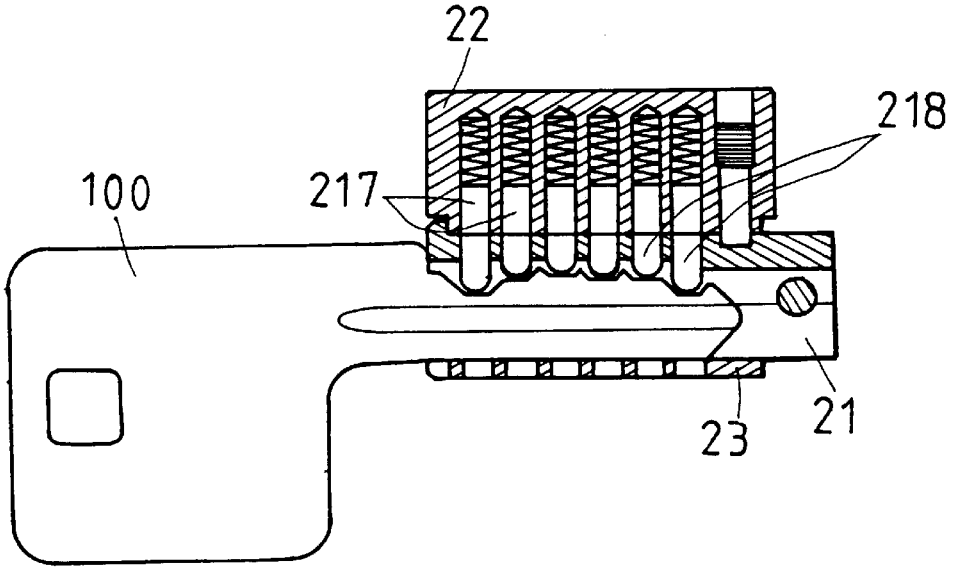
FIG. 7 is a cross-sectional view to show the locking pins are pushed to allow the cylinder rotatable relative to the sleeve when in an unlock status, and to show the locking bar is disconnected from the cylinder.

Referring to FIG. 7, when the correct key 100 inserted into the cylinder 21, the serrations of the key 100 push the locking pins 218 to compress the springs 216 so that the locking pins 218 are located to allow the cylinder 21 rotatable relative to the sleeve 23. Therefore, the elongated head 214 of the locking bar 211 is rotated so that the locking bar 211 can be removed from the recess 17 to unlock the lock.

If the base member 22 and the sleeve 23 are to be replaced, the bolt 16 is first removed, and the locking the base member 22 and the sleeve 23 can be easily removed from the case 10 and replaced.

Figure 8:
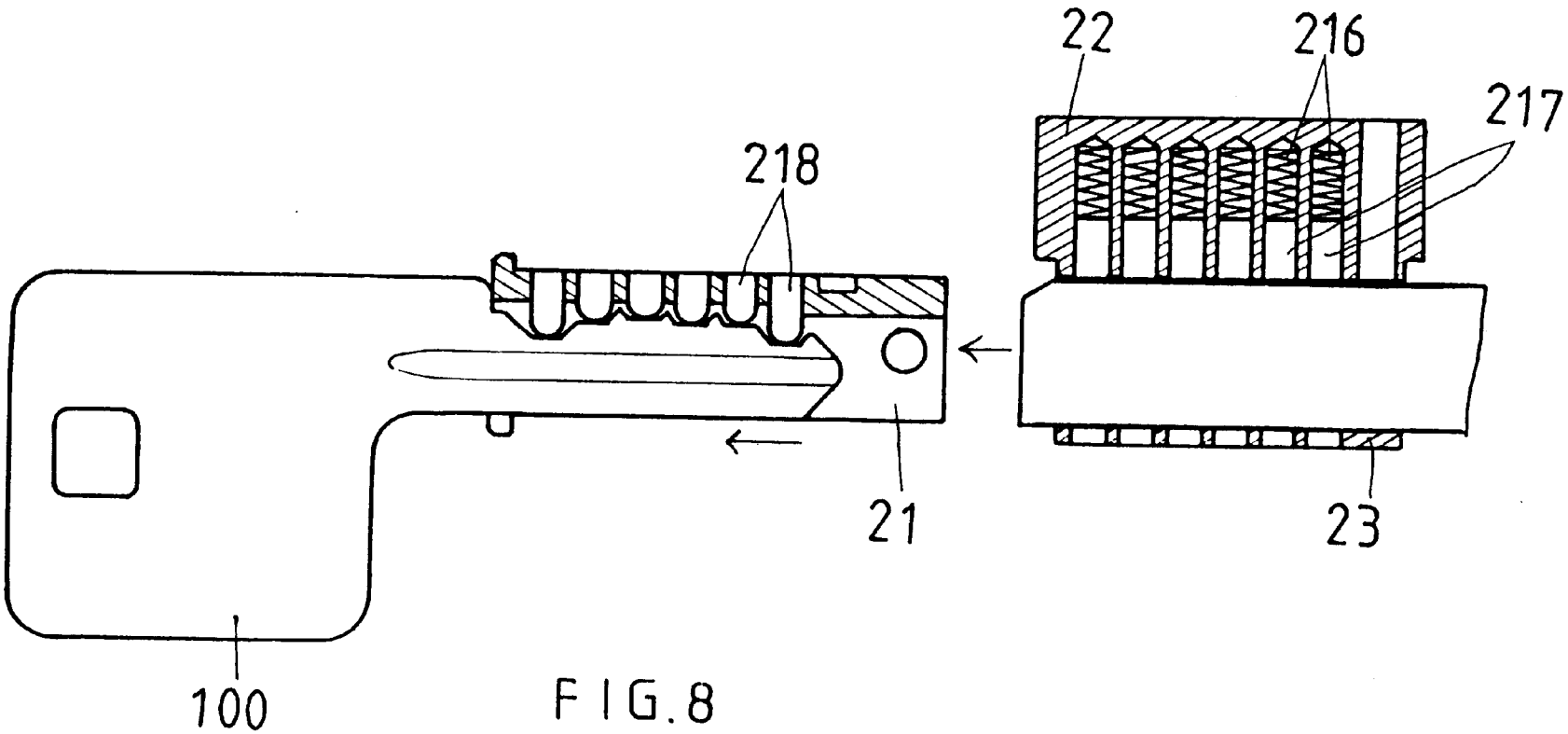
FIG. 8 is a cross-sectional view to show the locking pins together with the cylinder are removed from the sleeve with the movement of the key.
Figure 9:
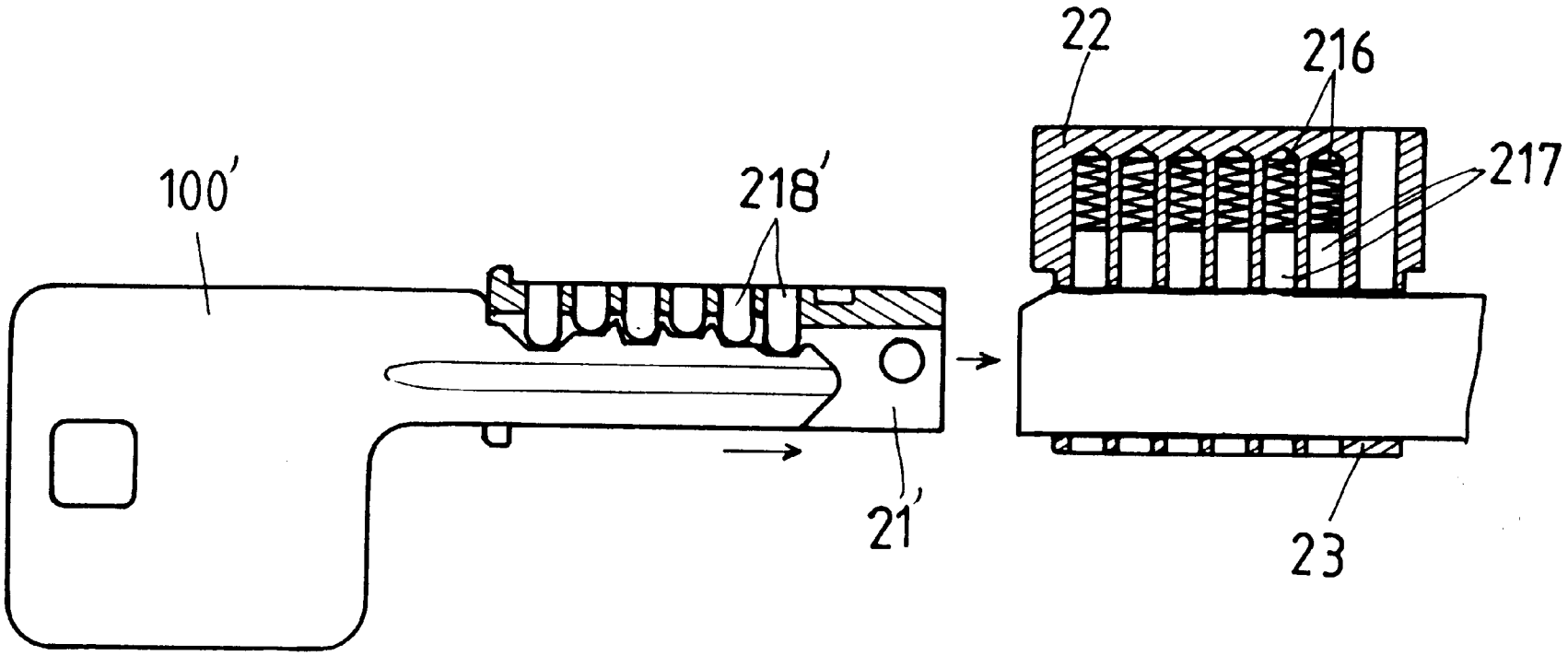
FIG. 9 is a cross-sectional view to show the new locking pins together with the cylinder are to be inserted into the sleeve by pushing a new key in the case.
Figure 10:
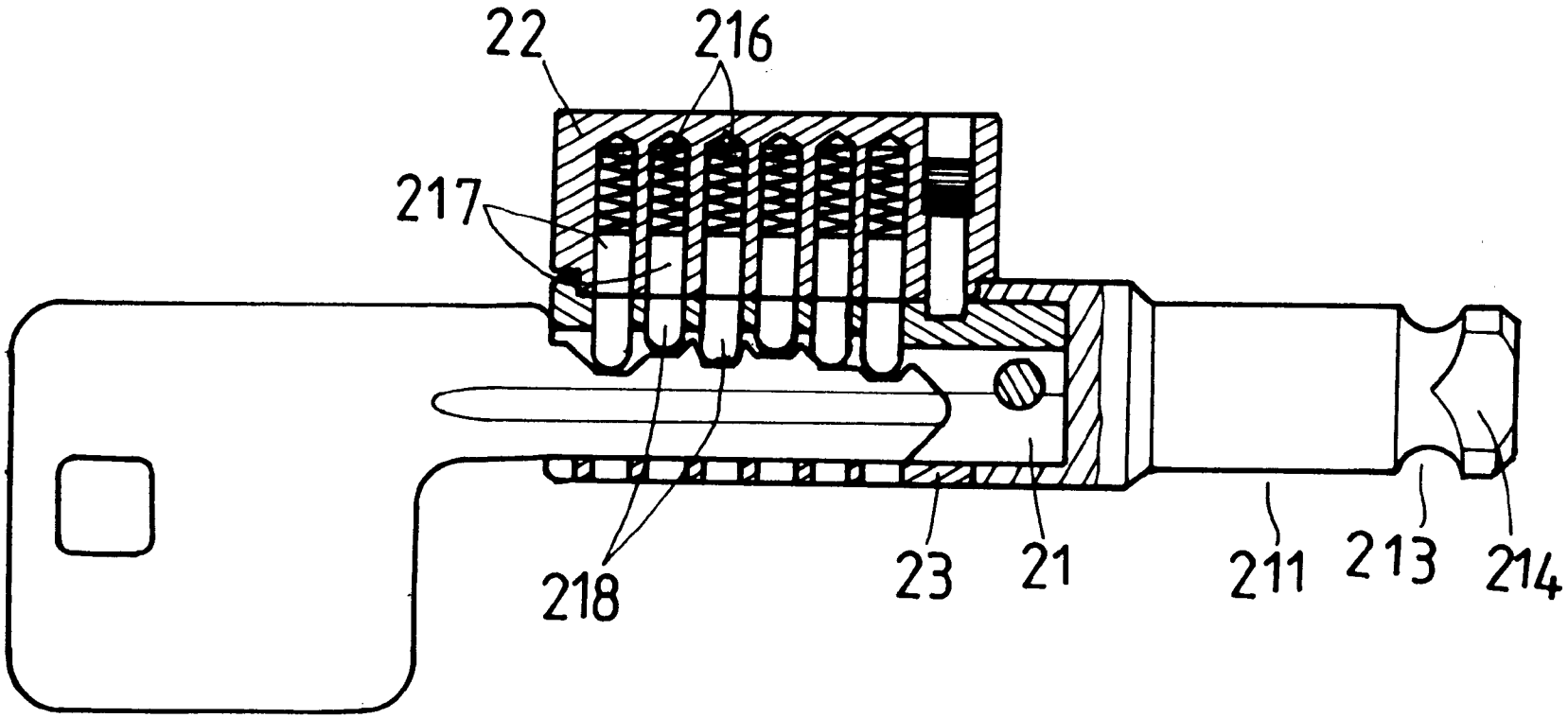
FIG. 10 is a cross-sectional view to show the new locking pins, the cylinder and the new key are inserted in to sleeve and the locking bar is connected to the cylinder.
Figure 11:
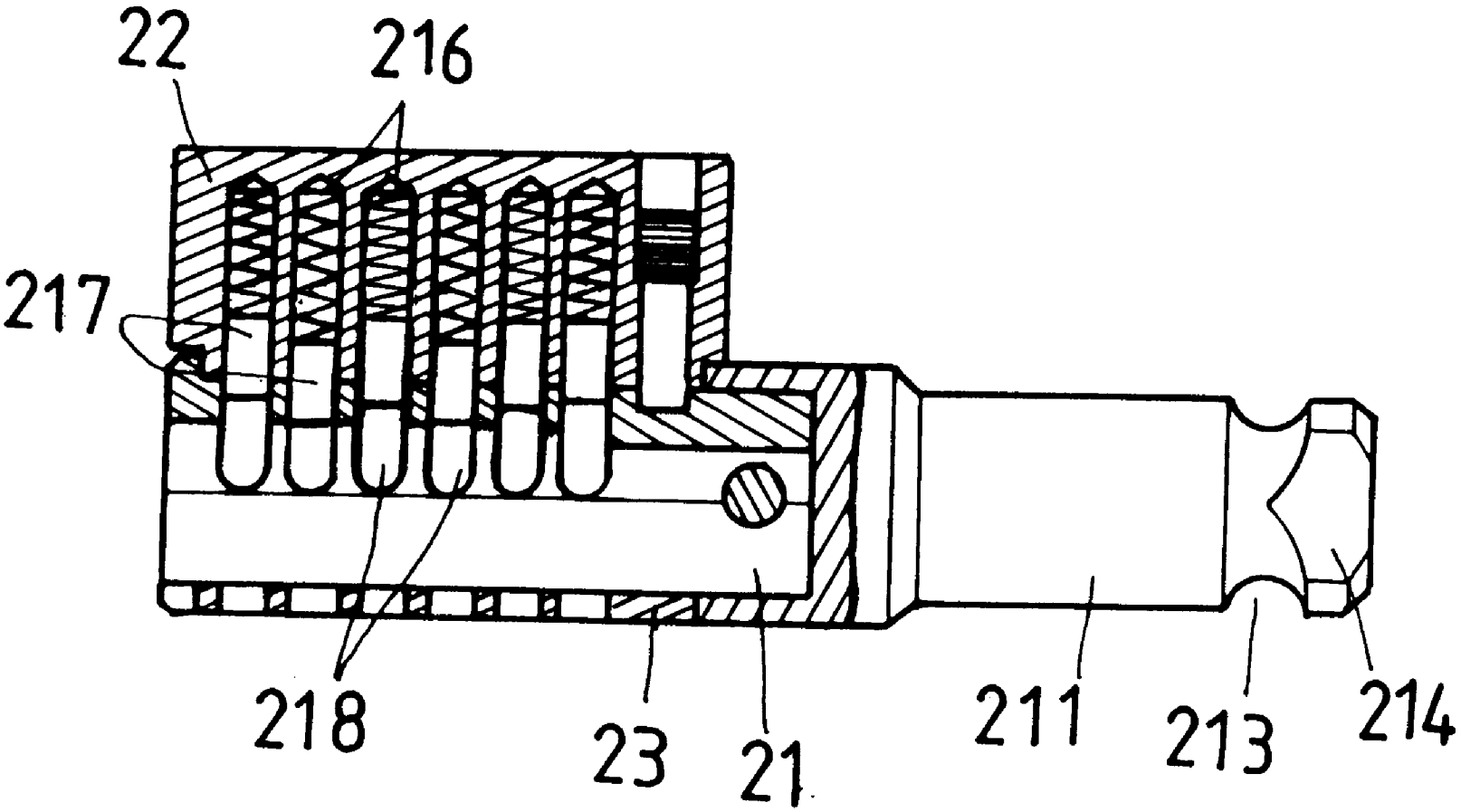
FIG. 11 is a cross-sectional view to show the new key is removed from the sleeve.

Referring to FIG. 8, if the cylinder 21 is to be replaced, the pin 212 is first removed and the locking bar 211 is disengaged from the cylinder 21, so that the cylinder 21 can be removed from the sleeve 23 together with the key 100. Therefore, the cylinder 21 can be replaced. Referring to FIGS. 9 to 11, a new cylinder 21' and/or new locking pins 218' can be cooperated with a new key 100', and all of them are inserted into the sleeve 23 so that the cylinder 21' and/or the locking pins 218' are inserted in the original case 10.

Accordingly, the lock of the present invention involves a feature which allows the user to change the cylinder 21, the locking pin 218 or the key 100 while the case 10 is remained the same.

While we have shown and described various embodiments in accordance with the present invention, it should be clear to those skilled in the art that further embodiments may be made without departing from the scope and spirit of the present invention.

What is claimed is:

1. A lock comprising:

a case having a slot defined therein and said slot defined by a first inside and a second inside, a recess defined in said first inside and having a narrow neck portion, a passage defined through said second inside, an engaging hole defined in said case and communicating with said passage;

a locking bar having a first end with a groove and an elongated head;

a sleeve connected to a base member, said sleeve and said base member both removably received in said engaging hole, said locking bar received in said sleeve so that said elongated head is received in said recess in said case and an inner periphery defining said narrow neck portion is engaged with said groove in said locking bar, a plurality of chambers defined radially through said sleeve and said base member, each chamber having a tube and a locking pin, both of said tube and said locking pin being biased by a spring received in said chamber in said base member, and a cylinder having a key hole and rotatably received in said sleeve, said cylinder connected to a second end of said locking bar by a pin.

2. The lock as claimed in claim 1, wherein said narrow neck portion in said recess is defined by two positioning bars respectively located in said recess.

3. The as claimed in claim 1 further comprising a threaded hole defined through said case and communicating with said engaging hole in said case, a notch defined in said base member so that a bolt extends through said threaded hole and is engaged with said notch.

* * * * *